US007605709B2

(12) United States Patent
Tolliver

(10) Patent No.: US 7,605,709 B2
(45) Date of Patent: Oct. 20, 2009

(54) SYSTEM, APPARATUS AND METHOD FOR SCREENING PERSONNEL

(76) Inventor: Charlie L. Tolliver, 6927 Crystal Point Dr., Katy, TX (US) 77449-6198

( * ) Notice: Subject to any disclaimer, the term of this patent is extended or adjusted under 35 U.S.C. 154(b) by 109 days.

(21) Appl. No.: 11/052,339

(22) Filed: Feb. 7, 2005

(65) Prior Publication Data

US 2006/0087439 A1 Apr. 27, 2006

Related U.S. Application Data

(60) Provisional application No. 60/542,686, filed on Feb. 9, 2004.

(51) Int. Cl.
*G08B 23/00* (2006.01)

(52) U.S. Cl. ..... 340/573.1; 340/521; 340/5.7

(58) Field of Classification Search ..... 340/573.1, 340/574, 576, 573.4, 573.7, 581, 521, 541, 340/5.12, 5.3, 5.32, 5.7; 73/864.81
See application file for complete search history.

(56) References Cited

U.S. PATENT DOCUMENTS 5,162,652 A * 11/1992 Cohen et al. ..... 250/288
5,815,252 A * 9/1998 Price-Francis ..... 356/71
5,915,268 A * 6/1999 Linker et al. ..... 73/23.2
6,148,094 A * 11/2000 Kinsella ..... 382/124
6,334,365 B1 * 1/2002 Linker et al. ..... 73/864.81
6,840,122 B1 * 1/2005 Jenkins et al. ..... 73/864.33
6,868,344 B1 * 3/2005 Nelson ..... 702/31
6,914,668 B2 * 7/2005 Brestel et al. ..... 356/72
6,952,163 B2 * 10/2005 Huey et al. ..... 340/521
6,952,164 B2 * 10/2005 Junqua ..... 340/539.13
7,135,980 B2 * 11/2006 Moore et al. ..... 340/573.1
7,136,513 B2 * 11/2006 Waehner et al. ..... 382/118
2003/0085348 A1 * 5/2003 Megerle ..... 250/287
2004/0199785 A1 * 10/2004 Pederson ..... 713/200
2005/0187883 A1 * 8/2005 Bishop et al. ..... 705/67

* cited by examiner

*Primary Examiner*—Daniel Previl
(74) *Attorney, Agent, or Firm*—Harish Dhingra; Dhingra & Associates

(57) ABSTRACT

Apparatus and techniques are provided for screening personnel at secured installations like airports, courthouses, police stations, secured administrative buildings, military installations and other installations requiring heightened security. The apparatus and the system integrate state of the art available technologies in biometric identification, metal detection, document identification, and body scan apparatus. All technologies are integrated to provide reliable, efficient and economic solution to security problems. A corresponding method of screening is provided.

47 Claims, 12 Drawing Sheets

SYSTEM, APPARATUS AND METHOD FOR SCREENING PERSONNEL

CLAIM TO EARLIER PRIORITY DATE

Date of the provisional patent application No. 60/542,686, filed on Feb. 09, 2004.

CROSS-REFERENCE TO RELATED APPLICATIONS

Provisional patent application No. 60/542,686, filed on Feb. 9, 2004. The Provisional patent application is fully incorporated herein by reference.

STATEMENTS REGARDING FEDERALLY SPONSORED RESEARCH OR DEVELOPMENT

None.

REFERENCE TO A MICROFICHE APPENDIX

Not Applicable.

BACKGROUND OF THE INVENTION

1. Field of the Invention

The present invention generally relates to security screening and surveillance, and more specifically to personnel screening at secured installations.

2. Description of the Related Art

Due to the terrorist attacks that have been plaguing the United States of America, and the world at large, the need for increased protection has become apparent. The current technology, although individually capable in various aspects, remains as a piecemeal approach to security related implementation objectives. On the other hand miscreants and terrorists have adopted ingenious mischief creating modes, e.g. hiding dangerous objects in shoes, in private parts, in hand carrying luggage, and in more unsuspecting ways and locations. This has caused difficulties for the security officials resulting in increased searches that cause inordinate delays and eventually become error prone primarily due to fatigue. In turn, this process causes frustration in the public utilizing secured public installation, e.g., airports, courthouses, governmental offices and so on. At times pat searches of the body have resulted in unpleasant and embarrassing situations. Efforts towards finding more efficient ways and means to make the society safer continue unabated. During the research of this subject matter it was noted that either antiquated equipment was being used and/or various sensors were being used in an uncoordinated way.

Various threats sources include unlawful carrying of weapons of different categories. Generally, these weapons may be categorized as weapons, e.g. guns, sharp edged metallic and non-metallic objects capable of causing serious physical harm, bio-terror matter and weapons, chemical and nuclear weapons and matter, and naturally occurring or synthetic narcotics. Although technology has been reasonably successful in separate disciplines, systems do not exist that can efficiently, and economically address the need for security system at public installations and facilities requiring heightened security.

Thus, multi-sensor approaches to security system design to overcome the difficulties mentioned above were investigated. Development of the systems appropriate for use in real-time that is efficient, less invasive, and comprehensive in detection of multiple threats were considered.

BRIEF SUMMARY OF THE INVENTION

Techniques for screening personnel at secured installations are presented. In an exemplary embodiment, a person seeking access to a secured installation is scanned to acquire are selected biometric-identifiers. Contemporaneously, the person is scanned for any unlawful/prohibited objects like weapons on the body of the person. Also, the person is scanned for unlawful/prohibited substances like narcotics and biological matter. The person's identifying documents like passport, driver license, or other issued documents are scanned and verified against a database when such a database may be available.

In another exemplary embodiment an apparatus for scanning personnel at secured installation is illustrated. A biometrics parameter scanner to acquire biometric-identifiers, a chemical analyzer to analyze narcotics, and hazardous biohazardous matter, a body scanner like X-ray scanner or a pulse induction sensor, at least one personal identification document scanners are coupled to a computer to provide alert for security violations and document information matching with a database typically provided by security agencies.

In still another embodiment a system corresponding to the technique illustrated is provided.

BRIEF DESCRIPTION OF THE SEVERAL VIEWS OF THE DRAWINGS

A better understanding of the present invention can be obtained when the following detailed description of some embodiments is considered in conjunction with the drawings of the above noted application and the following drawings in which.

DETAILED DESCRIPTION OF THE INVENTION

The observation that heightened security environment requires significantly increased screening of the personnel, which in turn causes significant delays and raised tempers amongst, for example, traveling public and possibly screening personnel. Such screening process not only causes delays for everyone, it results in diminished quality of surveillance. This diminished quality of surveillance results in enormous economic losses in terms of time and resources to, for example, airlines, related industries. The losses cascade throughout the economic ladder. In addition, most screening systems are not comprehensive and require frequent secondary screening like, for example, feet screening and body pat searches. These body pat searches are generally perceived to be too intrusive by the people and at times have been reported in the media to be abused by the security personnel.

Therefore, improved techniques for screening and corresponding apparatus are highly desirable where above-mentioned shortcomings may be minimized and quality of surveillance may be continuously improved. It is possible by providing apparatus that is accurate, comprehensive, and fast and has potential to increase the accuracy and speed by adapting the advancing state of art sensor technology.

The following is a detailed description of example embodiments of the invention depicted in the accompanying drawings. The embodiments are examples and are in such detail as to clearly communicate the invention. However, the amount of detail offered is not intended to limit the anticipated variations of embodiments; on the contrary, the intention is to cover all modifications, equivalents, and alternatives falling within the spirit and scope of the present invention as defined by the appended claims. The detailed descriptions below are designed to make such embodiments obvious to a person of ordinary skill in the art.

Figure 1:
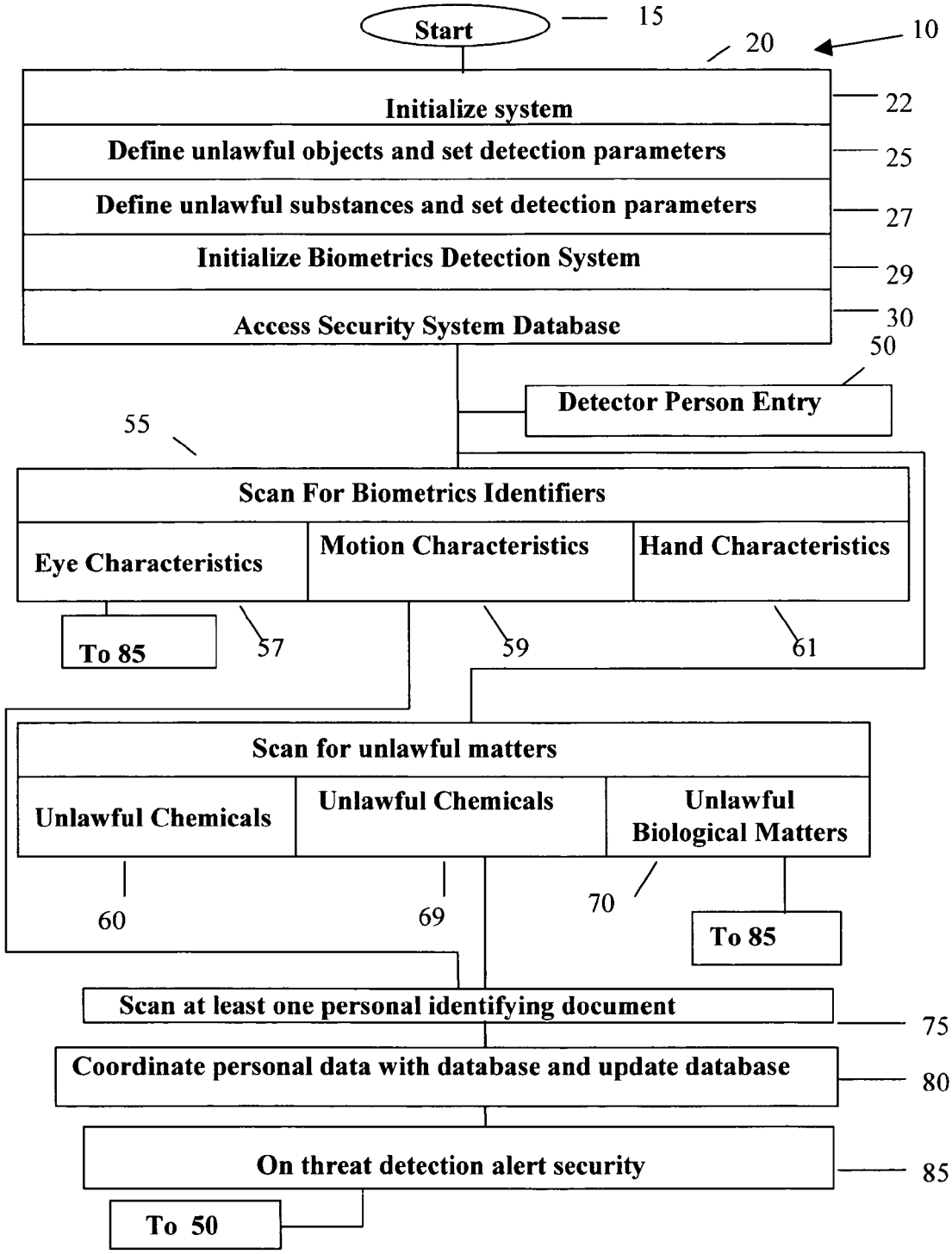
FIG. 1 is an overview flowchart of an exemplary embodiment illustrating the method of screening personnel.

Referring to FIG. 1, there is illustrated a system 10 outlining the method of screening personnel for security at secured installations. Certain databases that include personnel information of security risks may be available for some aspects of personnel identity verification. Typically, these databases are compiled by defense and security agencies. When such databases are not available, for example, at private agencies, the step of the method illustrated involving databases may be skipped and the remaining technique may still be utilized for the remaining functionalities. The secured installations may be any facility like airports, courthouses, legislative buildings, executive buildings and any industrial facilities requiring enhanced and comprehensive security.

Still referring to FIG. 1, upon start 15 of the system, various parameters of system are initialized 20. Typically, the system initialization 22 comprises defining parameters relating to defining the unlawful objects 25 and their detection parameters like detection characteristics and detection thresholds. The unlawful objects may typically be weapons like guns, knives, cutting objects and so on. Likewise, there is step of defining unlawful substances 27 by defining their chemical, and biological signatures and threshold levels of detection. The unlawful chemical substances may typically be prohibited narcotics/drugs, biological weapon/materials, nuclear weapon/materials, and other similar threatening weapon/materials. In step 29 the biometric detection system equipment is initialized to be ready for performing biometric aspects of the system. In step 30 the security system database is initialized for access for identity validation function of the system.

Still referring to FIG. 1, upon person's entry in the walk-through facility, a detector 50 senses presence of an individual. The individual is scanned to acquire biometric identifiers 55. Biometrics generally refers to technology of identification of individuals using biological traits, such as those based on retinal or iris scanning, fingerprints, or face recognition. The car, fingerprint, face, iris, facial thermo gram, retina, hand thermo gram, signature, hand vein, voice and hand geometry are different characteristics of biometric features which may be incorporated herein as the technology evolves. Some of these features like fingerprint, retina, and ears all hold a significant market share of research and development. There are some parts of the body that do not change as a person gets older, like eyes, finger prints, ears and other. The individual puts his/her hand(s) on the Hand-imager, which captures 61 the palm image. The palm image may also include fingerprint images. Other hand characteristics of interest may also be captured for comparison with the database. The fingerprint sensor captures the images and matches the uniqueness of each print and compares it to the ones stored in the local database. Types of fingerprint sensors include static capacitive, dynamic capacitive, optic reflective, optic transmissive with fiber plate, acoustic, pressure sensitive, thermal line, and optical line. All the types of the fingerprint sensors listed here are generally known as optical, semiconductor, and ultrasound sensors. Among all the sensors semiconductor sensors are considered to be low cost. Optical sensors are considered to have a high degree of stability and reliability, while ultrasound sensors are very precise and fraud-free. In an exemplary embodiment Touchprint 3800 Full Hand Scanner for palm imaging, manufactured by identix corporation of Minnetonka, Minn. was implemented. Other biometric parameters include capturing eye characteristics 57, and person's physical motion characteristics 59. The eye characteristics are a very powerful set of characteristics, such as retina image, iris image, are almost invariable during the lifetime of an individual. There is a very small fraction of population that has gone blind and has suffered significant eye characteristics damage. Such population presents a manageable task of manual screening compared to the entire population screening. In an exemplary embodiment an eye scanner manufactured by LG Electronics of Jamesburg, N.J. was used. All the information is cross-referenced with information stored in governmental, and security agencies databases. In an exemplary embodiment, the Peer Direct Corporation created database was chosen to store the identification information. This system was chosen because it is efficient and durable in the time of crisis like extensive system wide power failure. The motion characteristics include walking style, and other body movements during person's motion. In an exemplary embodiment a Sony DXC-9100P camera, a progressive scan color video camera was used for scanning the face. This camera has high resolution, instant digital still and motion picturing. Additional equipment is needed to transfer the digital image into a form that can be cross-referenced in the computer database. The Sony DXC-S500 Mega pixel camera and control unit was adapted for this purpose. In step 65 the scanning the person's body to detect unlawful objects on the person's body is performed. The scanning may be entire-body X-ray scanning. In another embodiment the scanning was performed using pulse induction technique for scanning the entire body. Other techniques of scanning may include thermal scanning, e.g. infrared scanning, of the body may reveal hidden non-biological matter. The unlawful chemicals 68 may include illegal drugs, whether manufactured or plant based drugs, unlawful explosive substances, and poisons. The unlawful weapons may include conventional weapons, sharp objects, harmful nuclear material, and like objects. The biological matter 71 may include biological weapons, synthetic or otherwise, and biohazard material. If either biometric identifier identifies a risky individual by finding a match in the database, or if an unlawful object is found on the individual, the security is alerted for further action.

Still referring to FIG. 1, in step 75 at least one personal identity document is scanned and the image and text are correlated 80 with the database. Such document may be a driver license, a passport, an identity document or similar document issued by a reliable authority. If any detrimental information is discovered, the security is alerted. If no adverse information is discovered the database is updated. If the database is not available at any particular installation, this step may be skipped and the remaining technique is carried out. The system is now ready for next individual to pass through.

Figure 2:
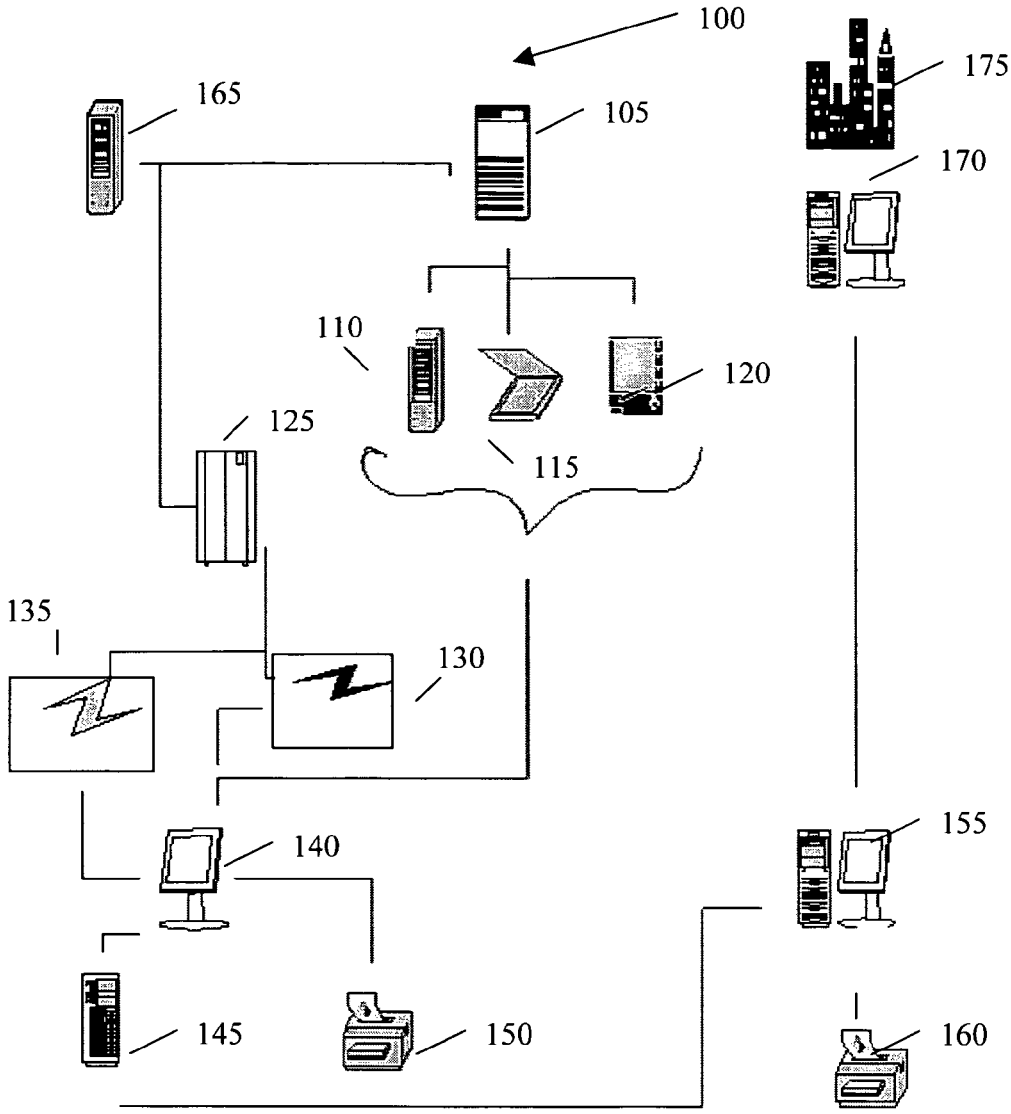
FIG. 2 is schematic of an exemplary embodiment illustrating overview of a system for screening personnel.

With reference to FIG. 2 is illustrated a schematic of a system and apparatus 100 of an exemplary embodiment illustrating overview of the system for screening personnel. A biometrics apparatus 105, in an exemplary embodiment, has an iris imager 110, a palm scanner 115 and an identity document scanner 120. One or more of these devices may be skipped based on need of security level. In an exemplary embodiment ID ScanPro for ID and passport scanning from Card Scanning Solutions of Los Angles, Calif. was implemented in the system. The biometrics apparatus is coupled to a database server 165. A walkthrough portal 125 having additional components of the system, to be described later, wherein these additional components are also coupled to the database server. The walkthrough portal 125 has a pulse induction sensor 135 on which the person stands and is scanned. The induction sensor 135 performs entire body scan for concealed unlawful objects by passing eddy currents through the body and locating unlawful objects. The pulse induction system scanner was found to be very versatile in that it could rapidly scan the entire body from head to toe and identify concealed objects. Typical pulse induction systems use a coil of wire on one side of the arch as the transmitter and receiver. This technology sends powerful, short bursts (pulses) of current through the coil of wire. Each pulse generates a brief magnetic field. When the pulse ends, the magnetic field reverses polarity and collapses very suddenly, resulting in a sharp electrical spike. This spike lasts a few microseconds and causes another current to run through the coil. This subsequent current is called the reflected pulse and lasts only about 30 microseconds. Another pulse is then sent and the process repeats. A typical pulse induction based metal detector sends about 100 pulses per second, but the number can vary greatly based on the manufacturer and model, ranging from about 25 pulses per second to over 1,000. In an exemplary embodiment the pulse induction sensor 135 manufactured by Garrett Metal Detectors of Garland, Tex. was used. In another embodiment X-ray scanning performed the body scan. The walkthrough portal 125 also has an explosives and narcotics chemical analyzer 130. In an exemplary embodiment GE ion Track manufactured by General Electric was used. The biometrics apparatus 105, the explosives and narcotics chemical analyzer 130, and the induction sensor 135 are coupled to a computer server 145. In an exemplary embodiment there is provided a control panel 140 for display and a printer 150 coupled to the server to permit optional printing.

Chemical agents are defined as chemicals intended to kill or seriously injure human beings. Chemical detection equipment usually detects the most common chemical agents, which include nerve agents, blister agents, and arsenical vesicants. A large variety of equipment is available that is capable of identifying liquid droplets and vapors of chemical agents. The premise of the multi sensor chemical detection is based on the diffusion of the molecules of chemical and biological agents. Diffusion is the spontaneous migration of substances from regions where their concentration is high to regions where their concentration is low. In the event someone was to attempt to conceal one of these agents, diffusion through the layered materials will allow molecules to disperse into the air. In addition to diffused molecules the handler of these materials, in all likelihood, will have traces on his/her hands and clothes. In adaptation of the multi sensor chemical detection, high pressure bursts of air dislodge some molecules from the person's body and send these molecules of the chemical into the air. The overhead fan directs the air to the chemical detection sensor. Several different technologies are used today to detect chemical agents. The following will explain in greater detail the intricacies of multi-sensor chemical detection. Ion Mobility Spectrometry (IMS) technology was adapted for detection of chemical agents. Air is drawn at atmospheric pressure into a reaction region. Samples of the air are ionized, ions travel through a charged tube where they collide with a detector plate and a current is registered. A plot of the current generated over time provides a characteristic ion mobility spectrum with a series of peaks. The height of the peaks in the spectrum, which corresponds to the amount of charge, gives an indication of the relative concentration of the agent present. The technique is especially suited for detecting nerve, blister, blood, choking, and mustard agents. An exemplary embodiment equipment manufactured by General Electric was adapted for ion Mobility Spectrometry.

In an exemplary embodiment the RMM Soft System was used to detect certain chemicals that have a high hazardous reaction with relation to any chemical destruction for creating a gas or a detonation device. The reaction chart will display high amplitude signal waves on the y-axis if a chemical that it detects is of any type of hazardous agents. If the chemical is non-hazardous, then it keeps a steady signal on the x-axis.

Still referring to FIG. 2, the server 145 is coupled to the security scanning facilities 155 for conveying the scanning information and any detected undesirable scenarios. The security scanning facilities 155 may further be coupled to law enforcement agencies database 170, which upon finding a match of the alleged law violator, may alert the law enforcement personnel, e.g., police 175.

Figure 3:
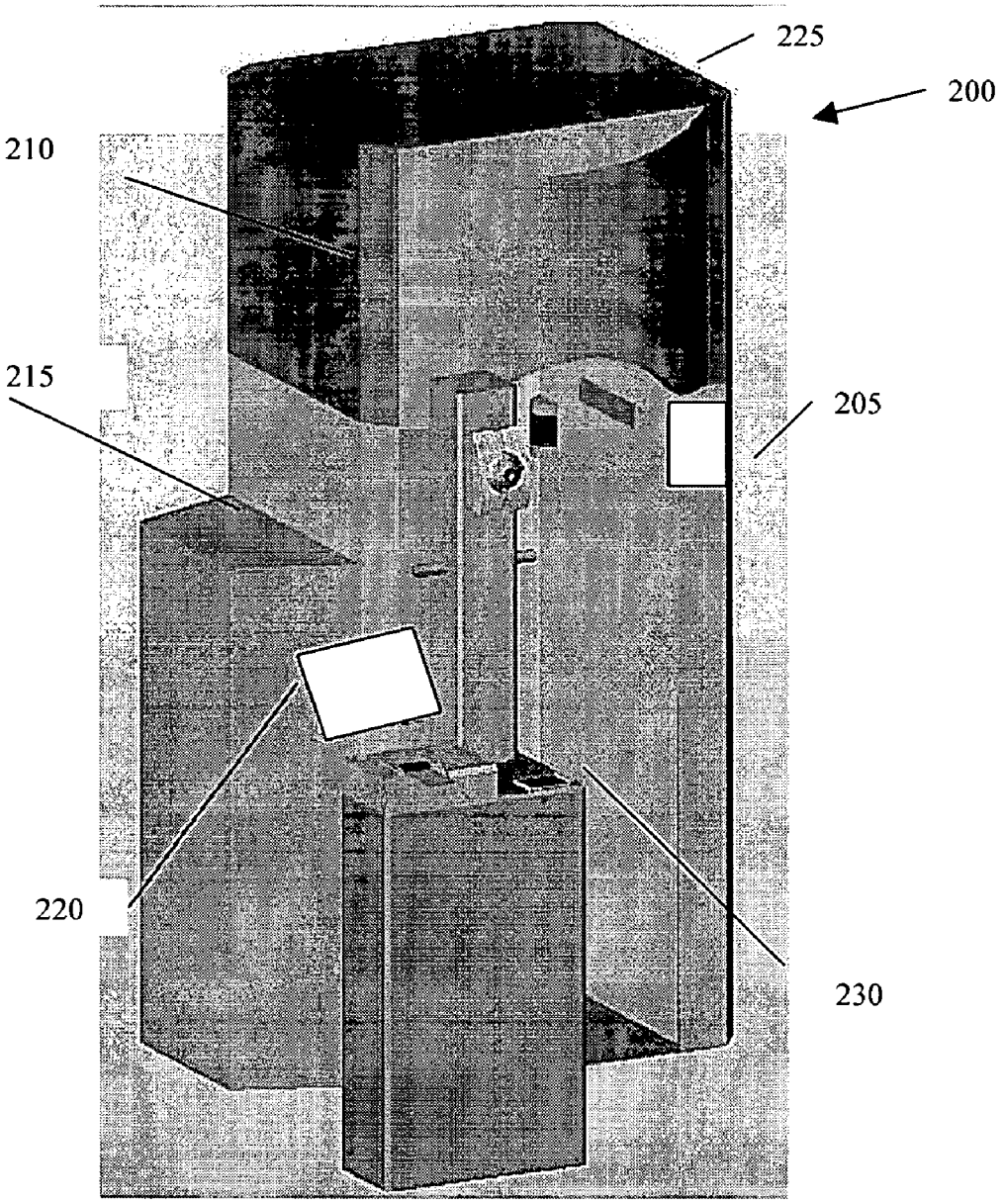
FIG. 3 is the front view of an exemplary embodiment of the system of FIG. 2.

With reference to FIG. 3, a system 200 of screening personnel is illustrated. A walkthrough portal 225 essentially houses scanning instruments and detectors. A walk-in indicator 205 shows that a person is being scanned, or the portal is available for scanning next person. An air particle suction fan 210 sucks air off of the individual (after air jets impart a small but fast jet of air to dislodge chemical matter off of the person) and sends to the chemical analyzer to detect unlawful chemical matter on the person's body. Nearly contemporaneously, an eye imaging 215 apparatus scans the eye for iris and/or retina scan image. The person in the portal puts his/her palm(s) on the palm scanning apparatus 220. The person also puts the personal identification document on the identification apparatus 230. The information acquired is quickly analyzed as detailed above and the person is either cleared to go forward or is detained if necessary.

Figure 4:
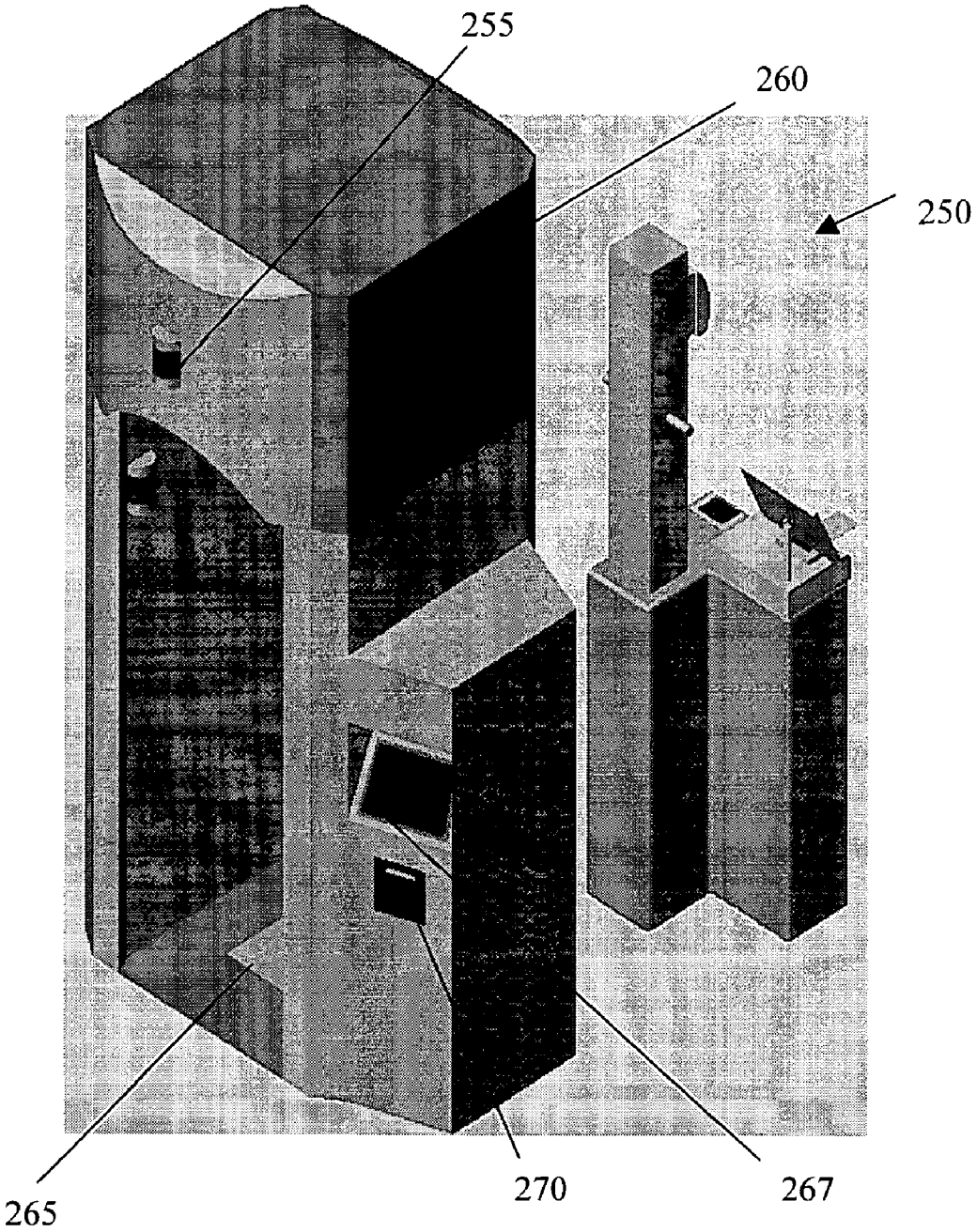
FIG. 4 is the rear view of the exemplary embodiment of the system of FIG. 3.

FIG. 4 is the rear view of an exemplary embodiment 250 of the system of FIG. 3. Pass-fail indicator 255 provides an external indication of a person passing/failing the screening examination for the monitoring personnel to take appropriate measures. An ionic trap analyzer analyzes the acquired chemicals and determines their signature and identifies the substances. As noted earlier the individual stands on the pulse induction sensor 265, which scans the body by inducing eddy currents in the body. In an exemplary embodiment the pulse induction sensor manufactured by Garrett Metal Detectors of Garland, Tex. was used. Also, a control panel 270 along with a printer is shown.

Figure 5:
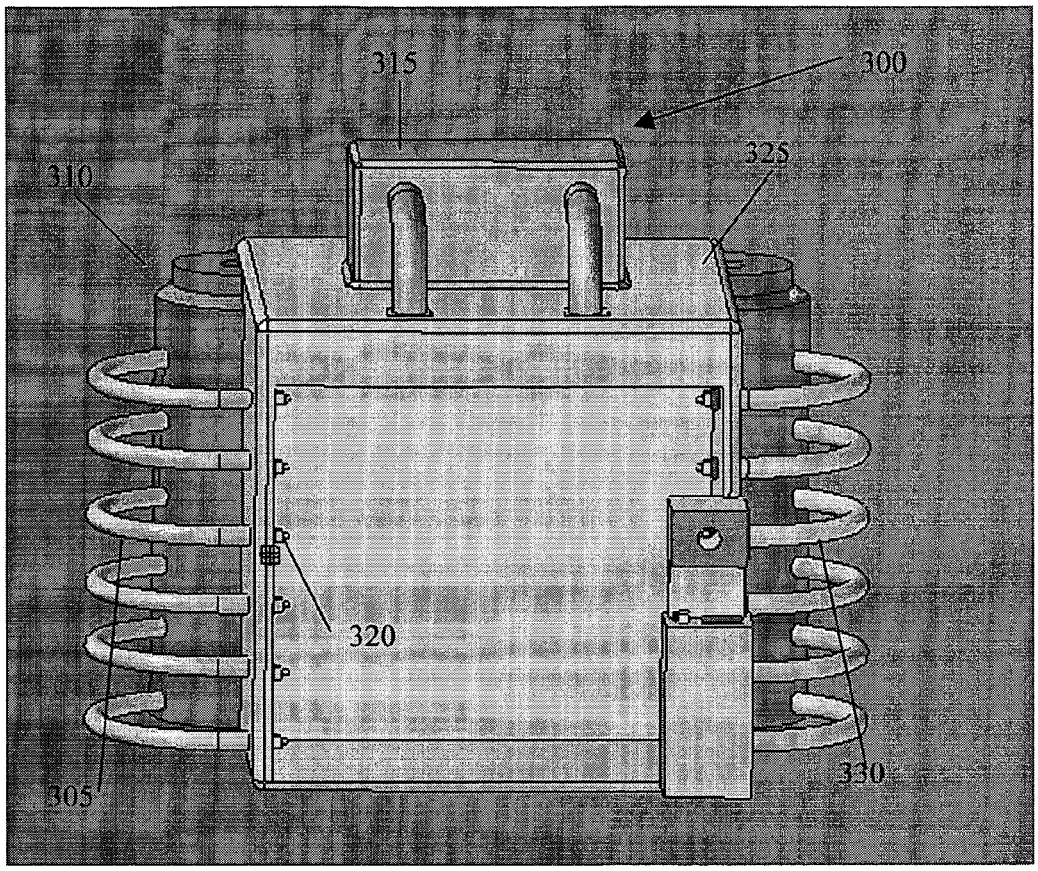
FIG. 5 is an overview an exemplary embodiment of the body of the chemical analyzer 300 of the system of FIGS. 3 and 4.

FIG. 5 is an overview an exemplary embodiment of the body of the chemical analyzer 300 of the system of FIGS. 3 and 4. An air tank 310 stores compressed air that is used in the air jets in small amounts to dislodge miniscule amount of chemical residue off of the individual being screened. An air compressor 320 keeps the compressed air supply available. Air from the air tank is carried through air hose 305. Air suction fan 325 removes the used air out of the walkthrough area. After usage, the air is sent to hood vent 315 for proper disposal.

Figure 6:
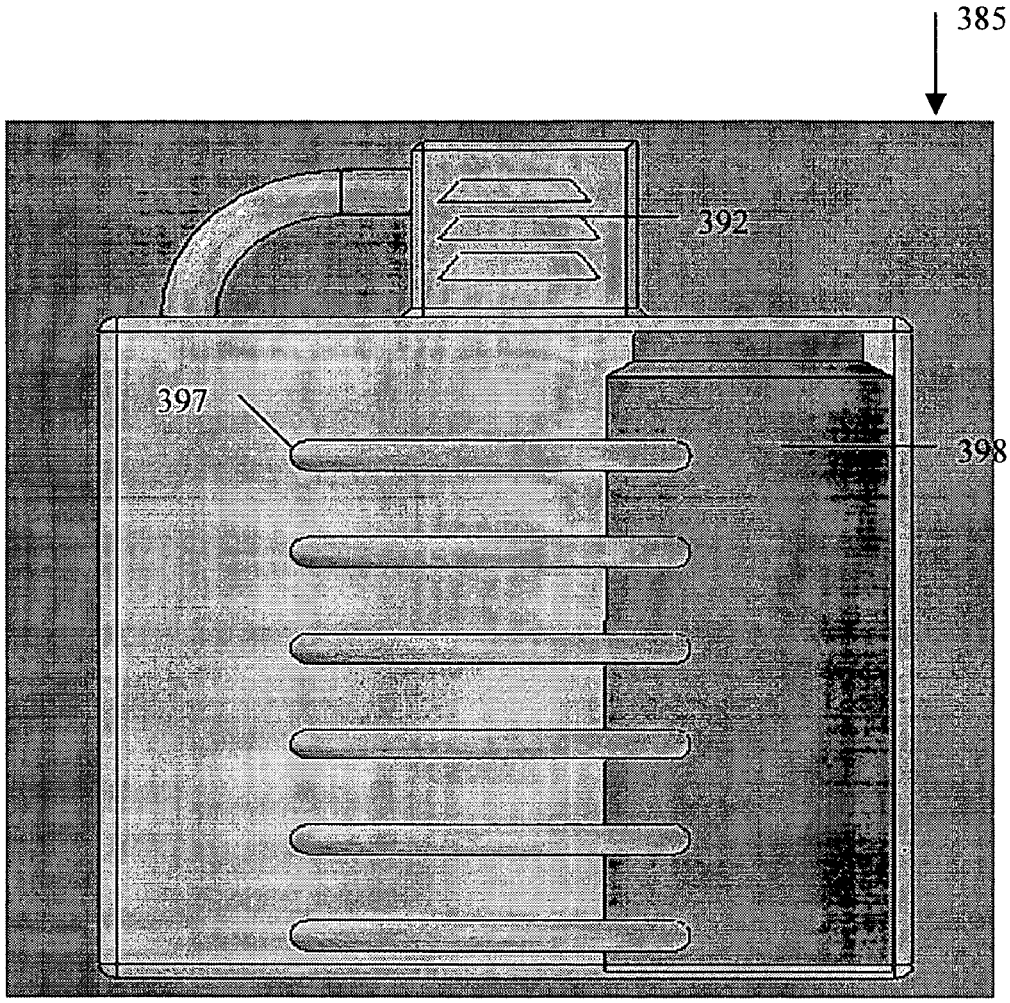
FIG. 6 is the side view of the chemical sensor illustrating the air-hose, the air-tank, and the hood-vent.

FIG. 6 is the side view 385 of the chemical sensor illustrating the air-hose 397, the air-tank 398, and the hood-vent 392.

Figure 7:
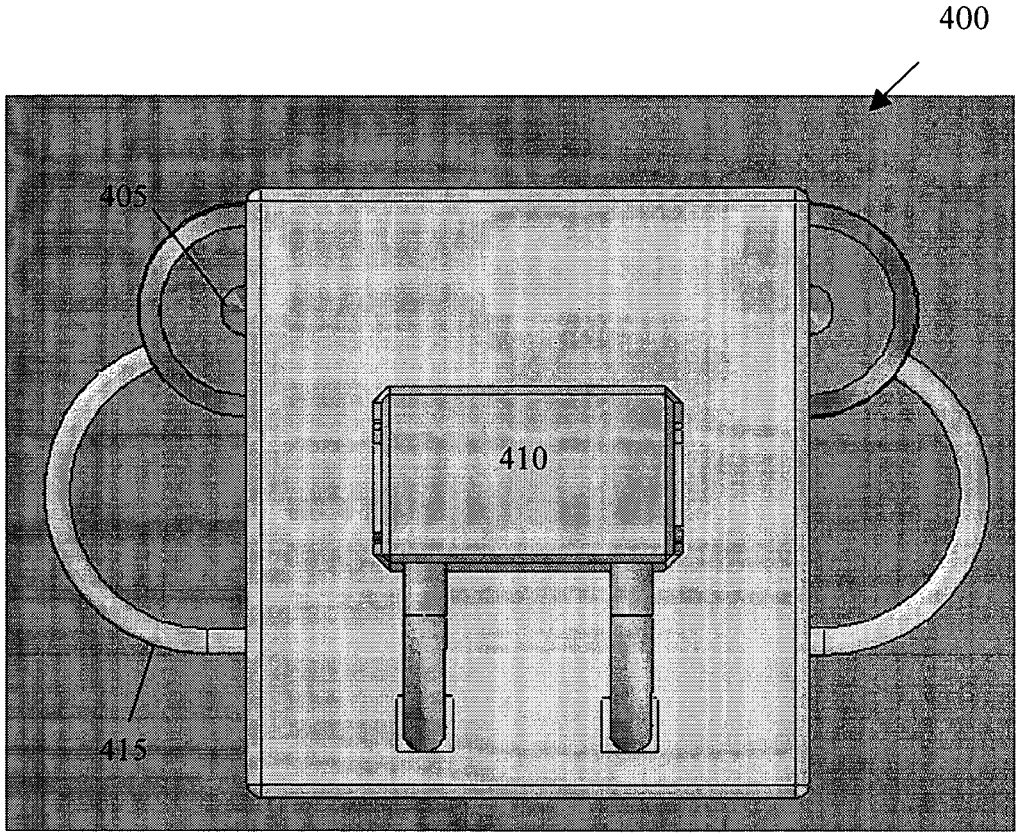
FIG. 7 is the top view of the chemical sensor illustrating parts of the right and left air tank, the hood-vent, and the air-hose.

FIG. 7 is the side view 385 of the chemical sensor illustrating the air-hose, the air-tank, and the hood-vent. The used air is sent out of a hood vent 392 through one or more air hose 397. The side view of the air tank 398 is also shown.

Figure 8:
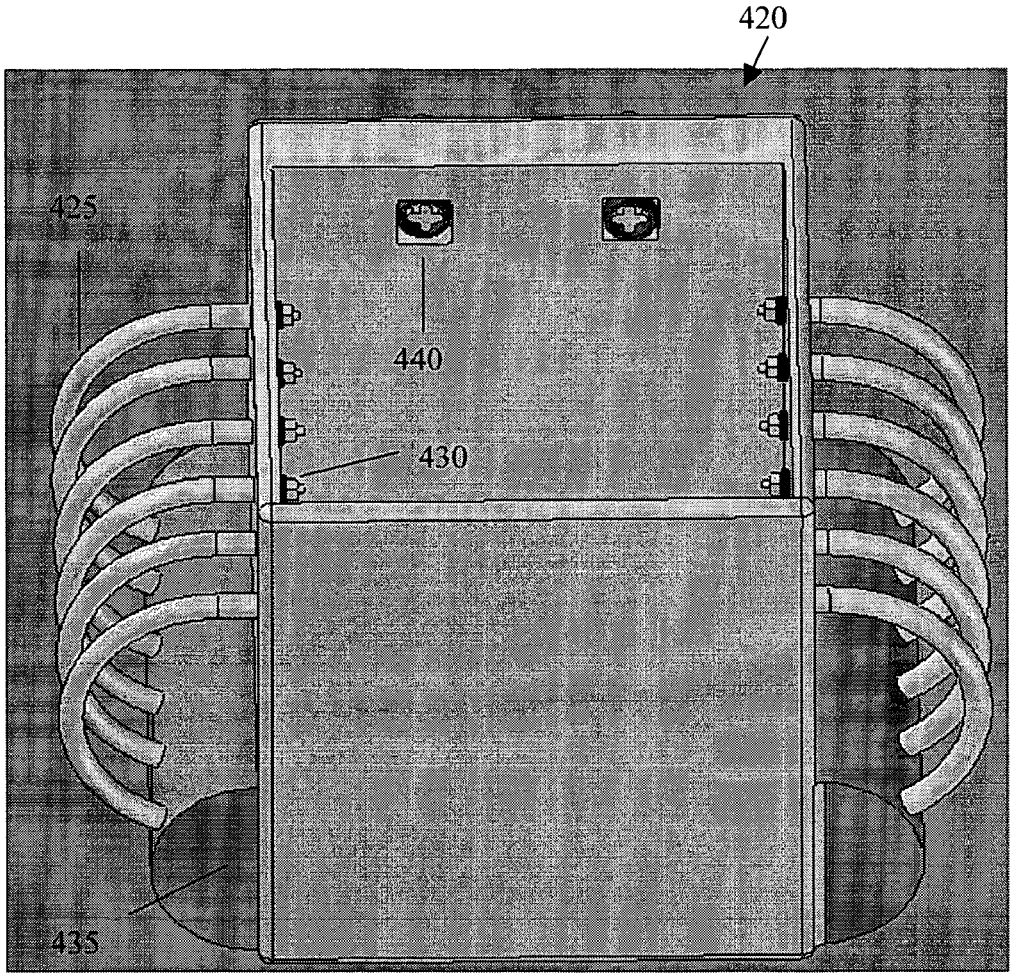
FIG. 8 is the bottom view of the chemical sensor illustrating the air-hose, air compressor, the air tank, and the air suction fan.

FIG. 8 is the top view 400 of the chemical sensor illustrating parts of the right and left air tank 405, the hood-vent 410, and the air-hose 415. Functions of the components have been described above.

Figure 9:
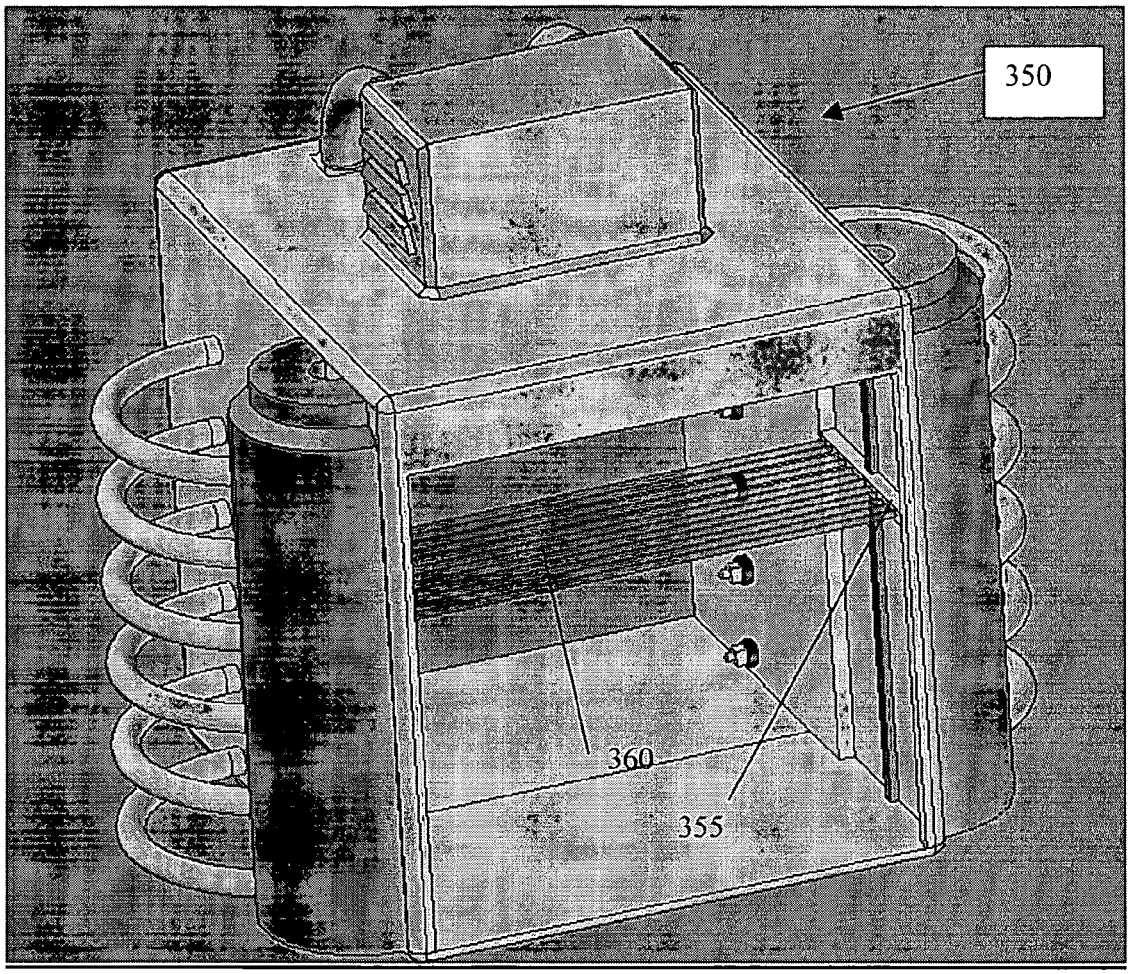
FIG. 9 is an X-ray body scan embodiment of the system of FIGS. 2-4.

FIG. 9 is an X-ray body scan 350 embodiment of the system of FIGS. 2-4 wherein the view shows approximately middle position of the X-ray beam 360. There is provided a moving XY-Bar 355, which includes X-ray equipment and the other side, detects the X-rays transmitted through the body. The XY-Bar moves up and down to scan the entire body. The technology of X-ray detection and equipment is well known to those of skilled in the art so that many variations may be adopted.

Figure 10:
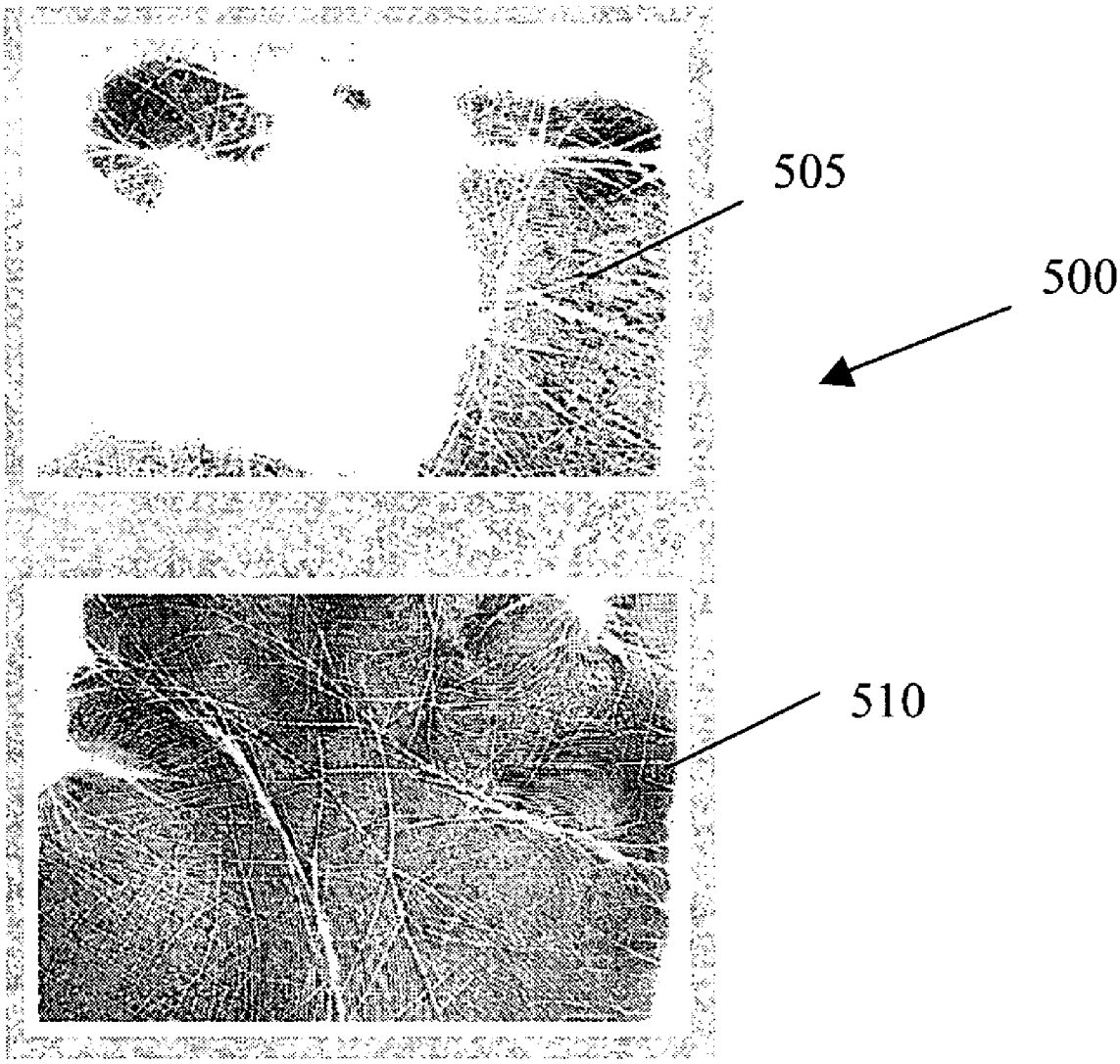
FIG. 10 shows difference in quality of a hand scan and a palm image.

FIG. 10 shows the contrast 500 between a typical hand scan 505 and a palm image 510. The photographic illustration shows the considerable contrast advantage of palm imaging used in this invention. As technology improves, the advancements can be easily incorporated in the system illustrated herein.

Figure 11:
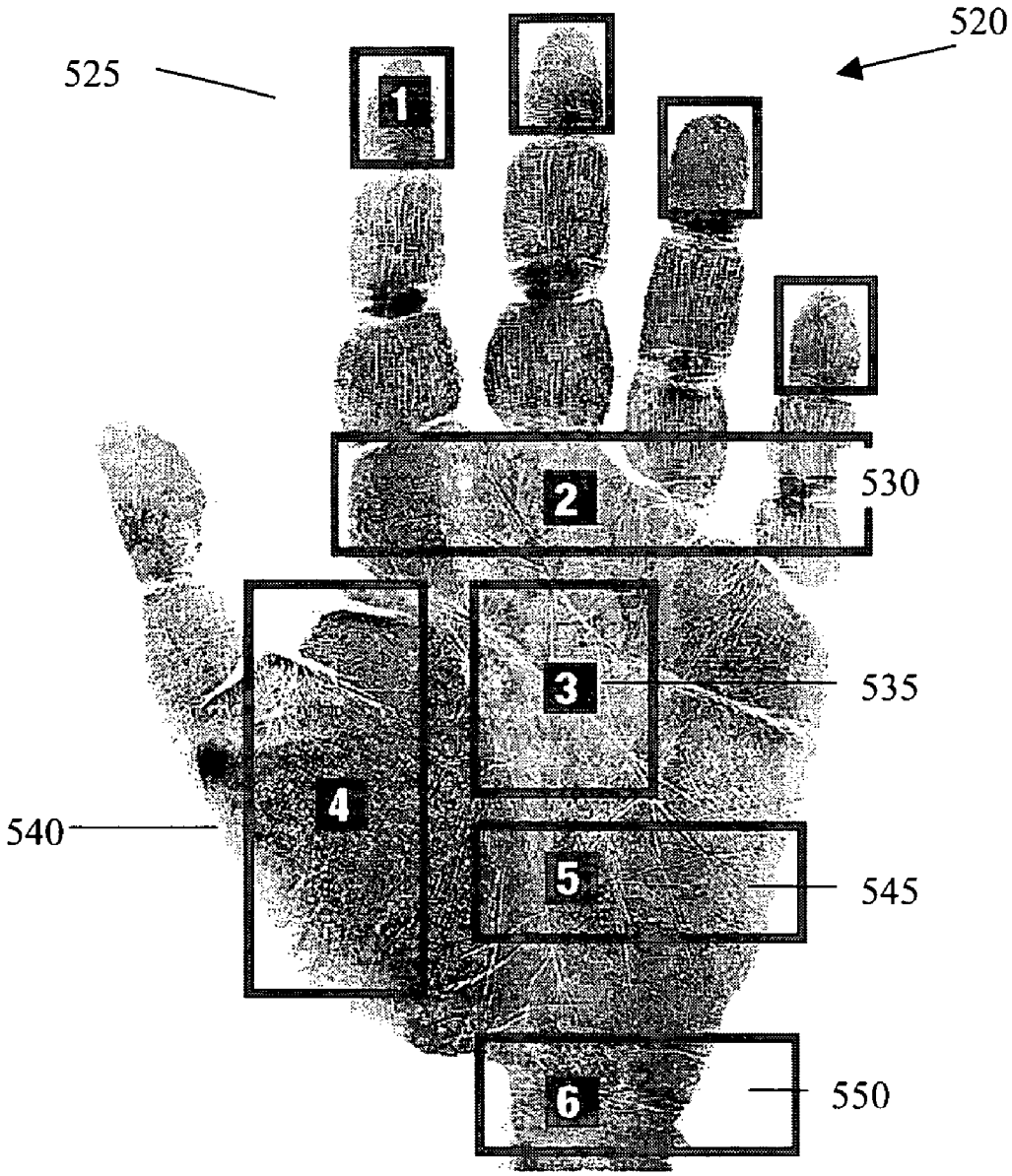
FIG. 11 shows the regions of interest in palm imaging.

FIG. 11 shows critical regions 520 of the palm image that also includes finger image. In an exemplary embodiment TouchPrint 3800 was used for palm imaging. TouchPrint 3800 makes it possible to capture the image of full hand in one scan. The FIG. 11 shows different regions of the hand that the device typically makes of someone's hand. From the top, the fingerprints 525 are at the top of the hand. Next is the interdigital area 530. The middle of the hand is called the cup 535. The region adjacent to the thumb is called the thenar 540. The lower part of the hand is called the hypothenar 545. The bottom of the hand is the carpal crease and writer's edge 550. All these critical regions may be captured in one image and are accurately matched.

Figure 12:
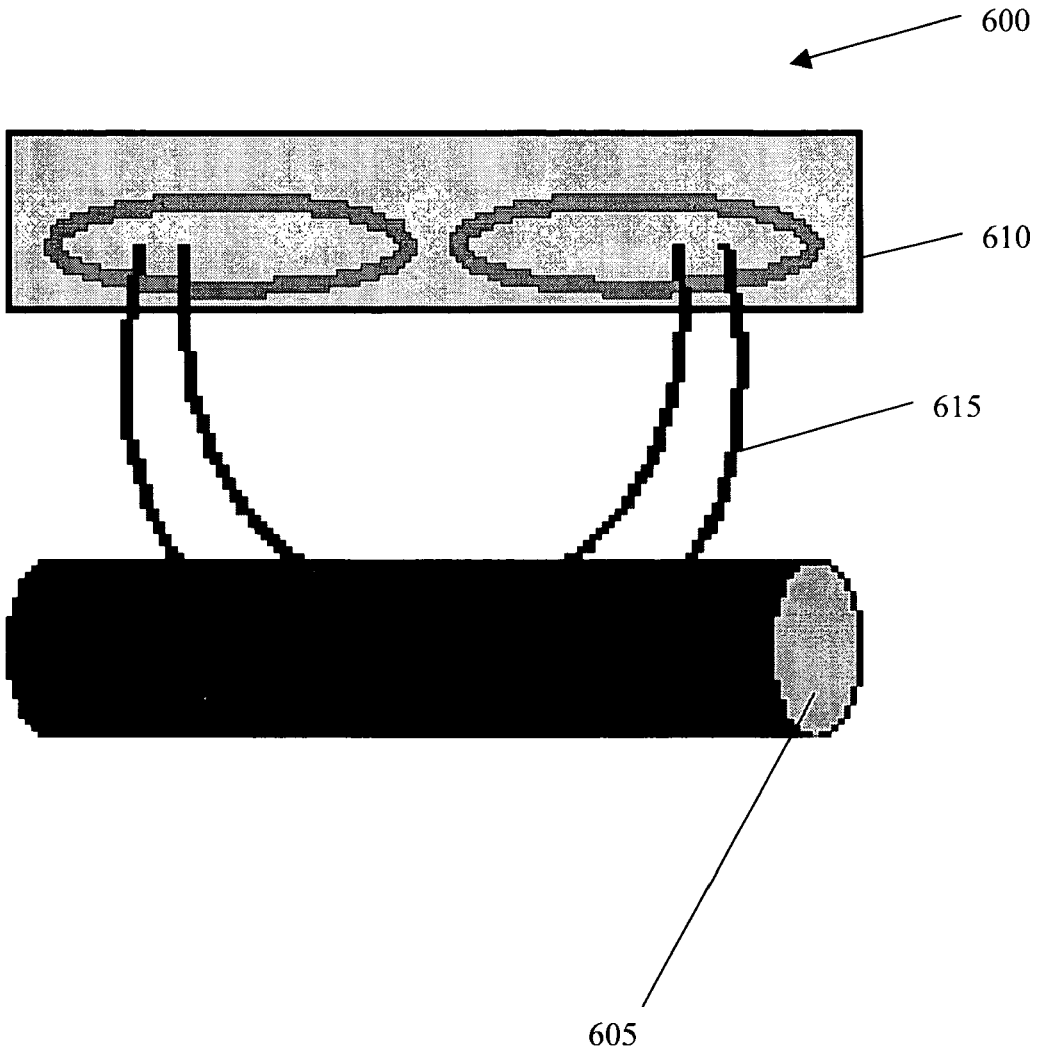
FIG. 12 shows the schematic of the pulse induction body scan technique.

FIG. 12 shows the schematic of the pulse induction body scan 600 technique. As explained elsewhere using pulse induction technique provides a non-invasive body scan where multiple concealed objects may be discriminated and detected. This highly advanced technology is programmed to recognize coins, belt buckles, money clips etc., and not set off the alarm for such trivial items. A magnetic coil 605 is exited to emit pulses, which induce eddy currents in the body. The person to be scanned stands on the platform 610. The magnetic field 615 penetrates the body to set up eddy currents. In an exemplary embodiment Intelliscan 9000 manufactured by Ranger Technology of El Paso, Tex. was used for the pulse induction scan.

The foregoing disclosure and description of the preferred embodiments are illustrative and explanatory thereof, and various changes in the components, elements, configurations, and signal connections, as well as in the details of the illustrated apparatus and construction and method of operation may be made without departing from the spirit and scope of the invention and within the scope of the claims.

The invention claimed is:

1. A method of screening personnel for security at secured installations, wherein certain databases are available for some aspects of personnel identity verification, the method comprising:

scanning selected biometric-identifiers of a person;

scanning the person's body to detect, by identifying the shape, unlawful non-chemical objects capable of inflicting physical injury concealed anywhere on the person's body, wherein the person's body comprises entire body including footwear, and wherein the unlawful non-chemical objects comprise guns, sharp edged metallic and non-metallic objects;

dislodging chemical substances from the person's body using high pressure air bursts;

analyzing an air sample containing dislodged substances using Ion Mobility Spectrometry (IMS) to detect unlawful substances, wherein the person's body further includes apparel and other articles worn by the person on the body;

scanning at least one available personal identifying document(s) to verify identity of the person in a personnel-database when such personnel-database available;

correlating personal data, wherein the personal data comprises certain biometric-identifiers, hand-identifiers, body scan results for detecting unlawful non-chemical objects concealed anywhere on the person's body, including footwear, and results of analysis of the air sample containing dislodged substances, with the personnel-database; and alerting security to take appropriate action when any problem(s) are detected with respect to personal identity, unlawful articles on the entire body, and unlawful substances on the entire body.

2. The method as in claim 1, wherein the scanning selected biometric-identifiers comprises scanning retina characteristics.

3. The method as in claim 1, wherein the scanning selected biometric-identifiers comprises scanning the iris.

4. The method as in claim 1, wherein the scanning selected biometric-identifiers comprises scanning physical motion characteristics.

5. The method as in claim 1, wherein the scanning selected biometric-identifiers comprises capturing identifying hand-identifiers.

6. The method as in claim 1, wherein the scanning selected biometric-identifiers comprises capturing fingerprint identifying characteristics.

7. The method as in claim 1, wherein scanning the person's body comprises entire body X-ray-scanning to detect unlawful objects capable of inflicting physical injury.

8. The method as in claim 1, wherein scanning the person's body comprises entire body thermal-scanning to detect unlawful objects capable of inflicting physical injury.

9. The method as in claim 1, wherein scanning the person's body further comprises pulse induction scanning person's body.

10. The method as in claim 1, wherein scanning the person's body to detect unlawful substances comprises detecting unlawful narcotics using IMS.

11. The method as in claim 1, wherein scanning the person's body to detect unlawful substances comprises detecting unlawful explosive substances using IMS.

12. The method as in claim 1, wherein scanning the person's body to detect unlawful substances comprises detecting unlawful biological substances using IMS.

13. The method as in claim 1, wherein scanning at least one available personal identifying document comprises scanning at least one document containing personal identifying information.

14. The method as in claim 13, wherein scanning at least one document containing personal identifying information comprises scanning the person's passport.

15. The method as in claim 13, wherein scanning at least one document containing personal identifying information comprises scanning the person's driver license.

16. The method as in claim 1, wherein correlating personal data with the personnel-database comprises correlating any of the personal identifying information with information in the personnel-database available to security agencies.

17. The method as in claim 1, wherein correlating personal data with the personnel-database further comprises updating the personnel-database when encountering new or missing information in the personnel-database.

18. A system for screening personnel for security at secured installations, wherein certain databases are available for some aspects of personnel identity verification, the system comprising:

means for scanning selected biometric-identifiers of a person;

means for scanning selected biometric-identifiers of a person;

means for scanning the person's body, by identifying the shape, to detect unlawful non-chemical objects capable of inflicting physical injury concealed anywhere on the person's body, wherein the person's body comprises entire body including footwear, and wherein the unlawful non-chemical objects comprise guns, sharp edged metallic and non-metallic objects;

means for dislodging chemical substances from the person's body using high pressure air bursts;

means for analyzing an air sample containing dislodged substances using Ion Mobility Spectrometry (IMS) to detect unlawful substances, wherein the person's body further includes apparel and other articles worn by the person on the body;

means for scanning at least one available personal identifying document(s) to verify identity of the person in a personnel-database when such personnel-database available;

means for correlating personal data, wherein the personal data comprises certain biometric-identifiers, hand-identifiers, body scan results for detecting unlawful non-chemical objects concealed anywhere on the person's body, including footwear, and results of analysis of the air sample containing dislodged substances, with the personnel-database; and means for alerting security to take appropriate action when any problem(s) are detected with respect to personal identity, unlawful articles on the entire body, and unlawful substances on the entire body.

19. The system as in claim 18, wherein means for scanning selected biometric-identifiers of a person comprises body motion scanner.

20. The system as in claim 18, wherein means for scanning selected biometric-identifiers of a person comprises eye iris scanner.

21. The system as in claim 18, wherein means for scanning selected biometric-identifiers of a person comprises retina scanner.

22. The system as in claim 18, wherein means for scanning selected biometric-identifiers of a person comprises a hand-imager.

23. The system as in claim 18, wherein means for scanning selected biometric-identifiers of a person comprises a fingerprint-imager.

24. The system as in claim 18, wherein means for scanning the person's body for unlawful objects capable of inflicting physical injury comprises X-ray Scanner.

25. The system as in claim 18, wherein means for scanning the person's body for unlawful objects capable of inflicting physical injury comprises pulse induction scanner.

26. The system as in claim 18, wherein means for scanning the person's body to detect unlawful chemical substances comprises Ion Mobility Spectrometer.

27. The system as in claim 18, wherein means for scanning at least one available personal identifying documents comprises passport scanner.

28. The system as in claim 18, wherein means for scanning at least one available personal identifying documents comprises driver license scanner.

29. The system as in claim 18, wherein the personnel-database comprises a database comprising personal information compiled by security agencies.

30. The system as in claim 18, wherein means for correlating personal data with the personnel-database comprises a computer programmed to identify a match with the personal data with entry in the personnel-database.

31. The system as in claim 18, wherein means for alerting security comprise audio alarms.

32. The system as in claim 18, wherein means for alerting security comprise visual displays.

33. An apparatus for screening personnel for security at secured installations, wherein certain databases are available for some aspects of personnel identity verification, the apparatus comprising:

a biometrics parameter scanner;

means for dislodging chemical substances from the person's body using high pressure air bursts;

an Ion Mobility Spectrometer;

an entire body, including footwear, scanner capable of detecting unlawful non-chemical objects capable of inflicting physical injury, wherein the unlawful non-chemical objects comprise guns, sharp edged metallic and non-metallic objects;

an identification document scanner; and a personnel database;

said biometrics parameter scanner, the means for dislodging chemical substances from the person's body using high pressure air bursts, the Ion Mobility Spectrometer, the entire body, including footwear, scanner capable of detecting unlawful non-chemical objects capable of inflicting physical injury and, the identification document scanner coupled to a processor comprising said personnel database.

34. The apparatus as in claim 33, wherein the biometrics scanner comprises an eye imaging camera to scan at least one of the eye parts.

35. The apparatus as in claim 33, wherein the at least one of the eye parts comprises iris.

36. The apparatus as in claim 33, wherein the at least one of the eye parts comprises retina.

37. The apparatus as in claim 33, wherein the biometrics scanner comprises a palm scanner.

38. The apparatus as in claim 33, wherein the biometrics scanner comprises a motion scanner.

39. The apparatus as in claim 33, wherein the controlled chemical substances analyzer comprises Ion Mobility Spectrometer.

40. The apparatus as in claim 33, wherein the bio-hazardous substance analyzer comprises Ion Mobility Spectrometer.

41. The apparatus as in claim 33, wherein the chemical weapon detector comprises Ion Mobility Spectrometer.

42. The apparatus as in claim 33, wherein the body scanner comprises body X-ray scanner.

43. The apparatus as in claim 33, wherein the body scanner comprises pulse induction scanner.

44. The apparatus as in claim 33, wherein the identification document scanner comprises passport scanner.

45. The apparatus as in claim 33, wherein the identification document scanner comprises driver license scanner.

46. The apparatus as in claim 33, wherein the identification document scanner comprises personal identity document scanner.

47. The apparatus as in claim 33, wherein the personnel database comprises security related personnel information.

* * * * *